US005829063A

United States Patent [19]

Cheng

[11] Patent Number: 5,829,063

[45] Date of Patent: Nov. 3, 1998

[54] LUMINESCENT CAP THAT POSSESSES A FUNCTION FOR REPLACING PATTERNS

[76] Inventor: Tong-Hsin Cheng, No. 14, Lane 133, Min Chuan West Rd., Taipei City, Taiwan

[21] Appl. No.: 8,888

[22] Filed: Jan. 12, 1998

[51] Int. Cl.[6] ..... A42B 1/24

[52] U.S. Cl. ..... 2/209.13; 2/906; 40/329; 40/544; 362/106

[58] Field of Search ..... 2/209.13, 906; 362/106, 107; 40/124.02, 124.06, 329, 542, 543, 544, 586, 714, 716

[56] References Cited

U.S. PATENT DOCUMENTS 4,999,936 3/1991 Calamia et al. ..... 40/544

5,570,946 11/1996 Chien ..... 362/106

*Primary Examiner*—Diana L. Biefeld

*Attorney, Agent, or Firm*—Pro-Techtor International Services

[57] ABSTRACT

The present invention provides a type of luminescent cap that possesses a function for replacing patterns. A frame that allows placement of objects is securely installed on the front edge of the cap. A luminescent board that emits luminescence and a pattern card are inserted in the frame that allows placement of objects. The luminescence emitted by said luminescent board can, through the transparent position of the pattern card, produce the effect of a luminescent pattern. Users are also able, according to need, to remove and replace pattern cards of different patterns, causing the cap to have greater practical value.

1 Claim, 5 Drawing Sheets

LUMINESCENT CAP THAT POSSESSES A FUNCTION FOR REPLACING PATTERNS

FIELD OF THE INVENTION

The present invention is a type of luminescent cap that possesses a function for replacing patterns. A frame that allows placement of objects is securely installed on the front edge of the cap. In the frame that allows placement of objects are inserted a luminescent board that emits luminescence and a pattern card. The luminescence that is emitted by the luminescent board is able, by means of a transparent position of the pattern card, to produce the effect of a luminescent pattern. Users are also able, according to need, to remove and replace pattern cards of different patterns, causing the cap to have greater practical value.

BACKGROUND OF THE INVENTION

Some of the patterns of conventional caps are fixed in position by printing or embroidery. At night or under conditions of insufficient light, the pattern on the cap cannot be recognized. In the conventional art, a luminescent device might be added, but the pattern is still in a fixed condition and cannot be replaced. Therefore, how to provide a lively and ingenious function for replacing patterns by means of a simple, convenient, and reliable device structure is a problem that the industry has been hoping to solve. In view of the fact that conventional caps are unable to meet the diversified needs of present users, the inventor of the present invention devoted himself to research and repeatedly performed tests and made improvements. Now, finally, he has developed a type of luminescent cap that possesses a function for replacing patterns in order that the defect of monotony and dullness of conventional products be truly remedied.

PURPOSE OF THE INVENTION

The primary purpose of the present invention is to provide a type of luminescent cap that possesses a function for replacing patterns. A frame that allows placement of objects is securely installed on the front edge of the cap. In the frame that allows placement of objects are inserted a luminescent board that emits luminescence and a pattern card. The luminescence that is emitted by the luminescent board is able, by means of a transparent position of the pattern card, to produce the effect of a luminescent pattern. Users are also able, according to need, to replace the card with pattern cards of different patterns, causing the cap to have greater practical value.

In order that the examination committee have a concrete understanding of the characteristics of the present invention, the advantages of the present invention can be understood from the embodiments below and with the help of the drawings that explain it in detail.

DETAILED DESCRIPTION OF THE INVENTION

Figure 1:
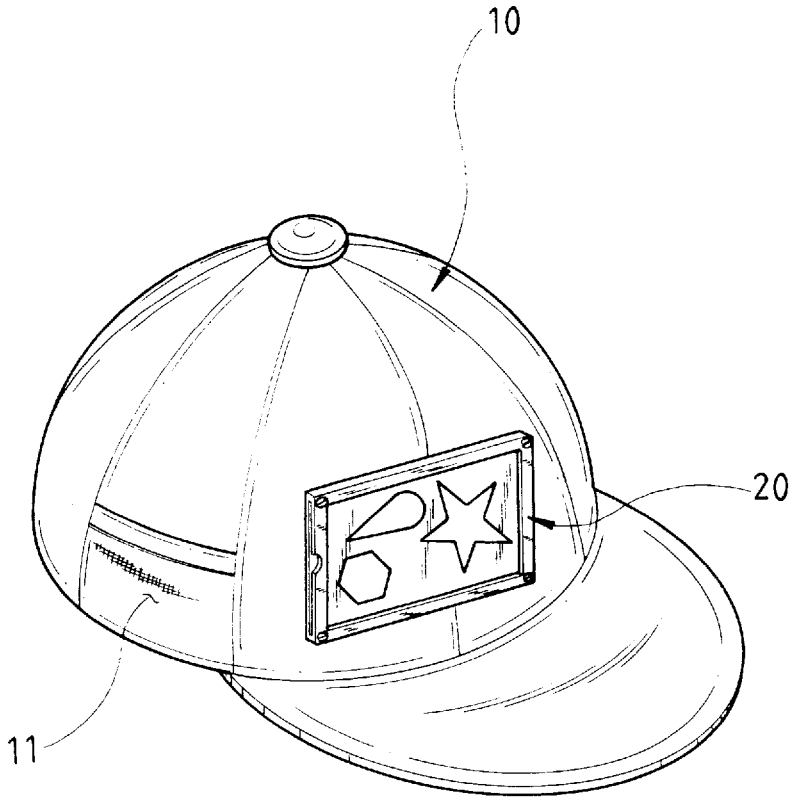
FIG. 1 is a three-dimensional structural schematic drawing of the assembly of the present invention.
Figure 2:
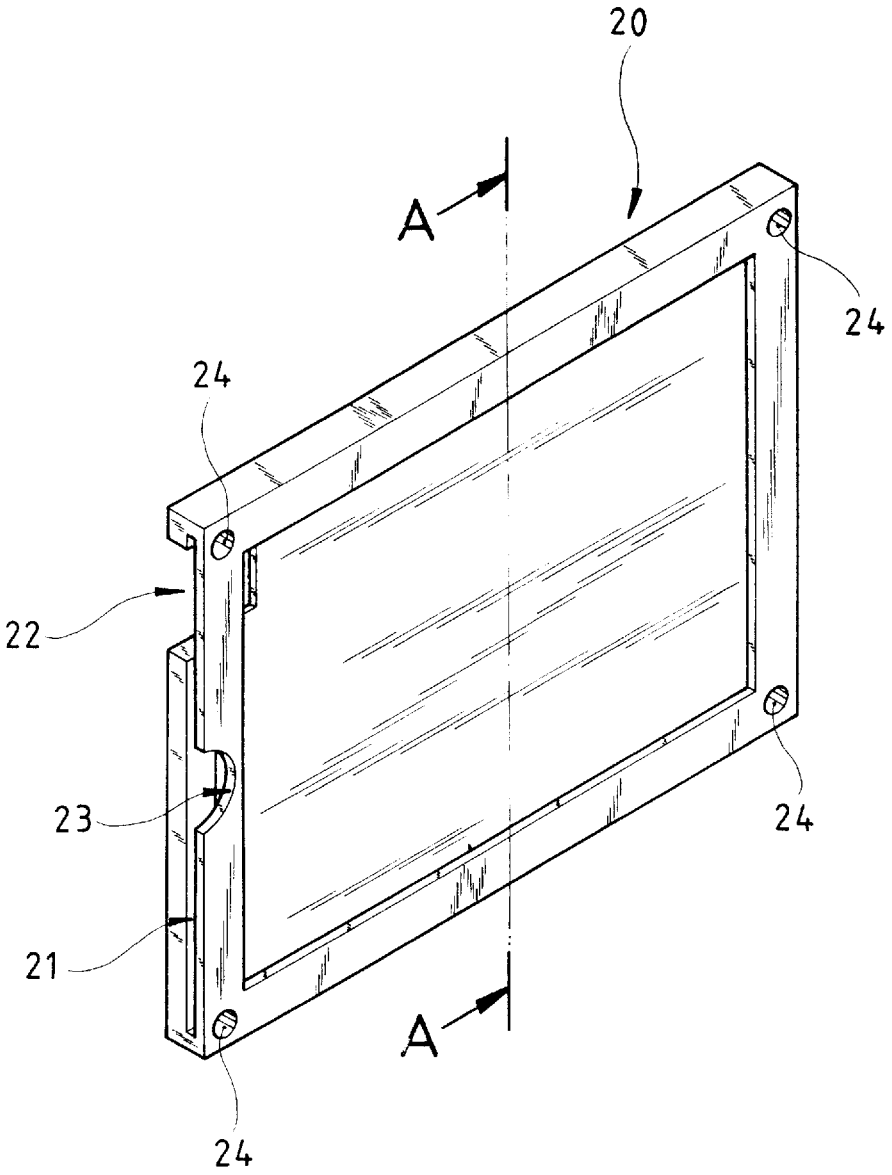
FIG. 2 is a structural schematic drawing of the frame that allows placement of objects (20) of the present invention.
Figure 3:
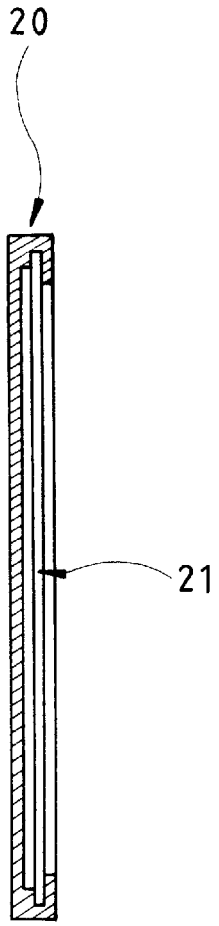
FIG. 3 is a sectional structural schematic diagram of "A—A" in FIG. 2 of the present invention.

First of all, the present invention provides a type of luminescent cap that possesses a function for replacing patterns. It primarily comprises these structural components: a cap (10), a frame that allows placement of objects (20), a luminescent board (30), a battery assembly (40), a circuit board (50), and a pattern card (60). Of these: The cap (10). Please consult FIG. 1. One side of said cap (10) provides a pocket that allows placement of an object (11). Please consult FIGS. 2 and 3. Inside the frame that allows placement of objects (20) is provided a hollow, bi-level slot that allows placement of objects (21). Said frame that allows placement of objects (20) provides a rectangular slot aperture (22) on the left-side corner of the edge of the base. Furthermore, said frame that allows placement of objects (20) provides a semi-circular slot aperture (23) in the center of the left side of the frame, and each of the four corners of the frame that allows placement of objects (20) provides a circular aperture (24) that passes through from one side to the other.

Figure 4:
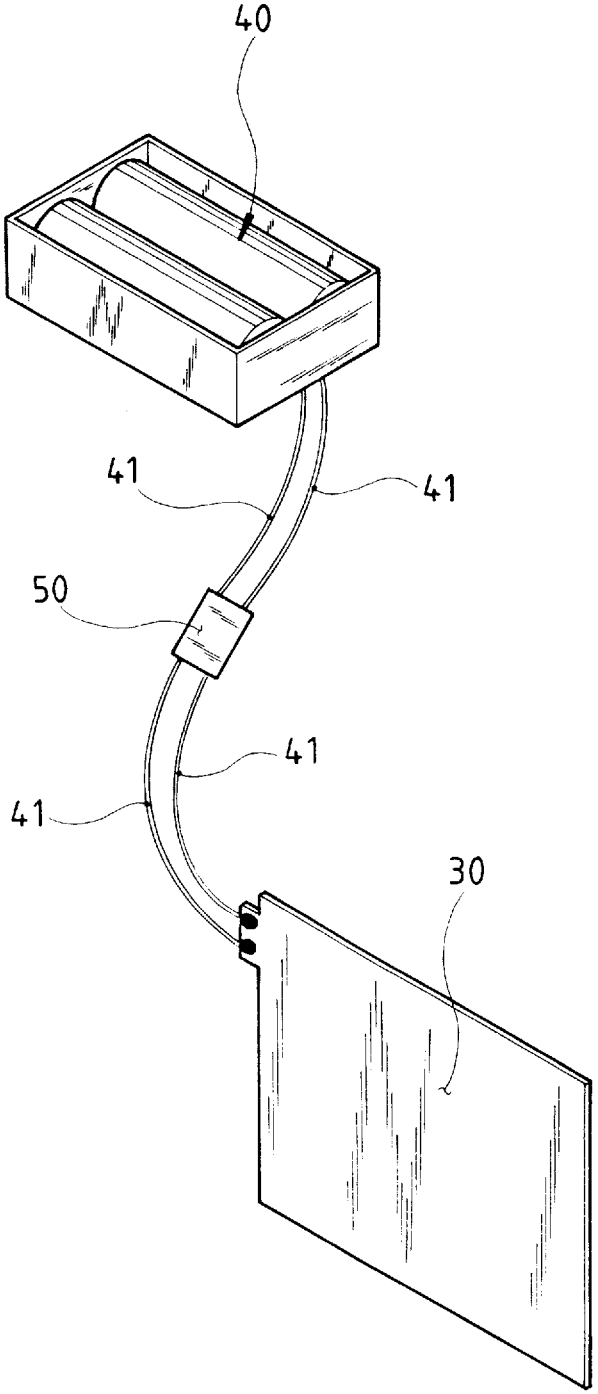
FIG. 4 is a structural schematic diagram of the connection between the luminescent board (30) and the battery compartment (40) of the present invention.

Please consult FIG. 4. The luminescent board (30) is connected to one circuit board (50) by a connecting wire (41) between it and the battery assembly (40), thereby enabling the luminescent board (30), by means of the electricity supplied by the battery assembly (40), to emit luminescence for more than 72 hours continuously. (Said luminescent board (30), battery assembly (40), and circuit board (50) are commonly-known products. A thorough and detailed description of their technical characteristics will not be separately provided.)

Figure 5:
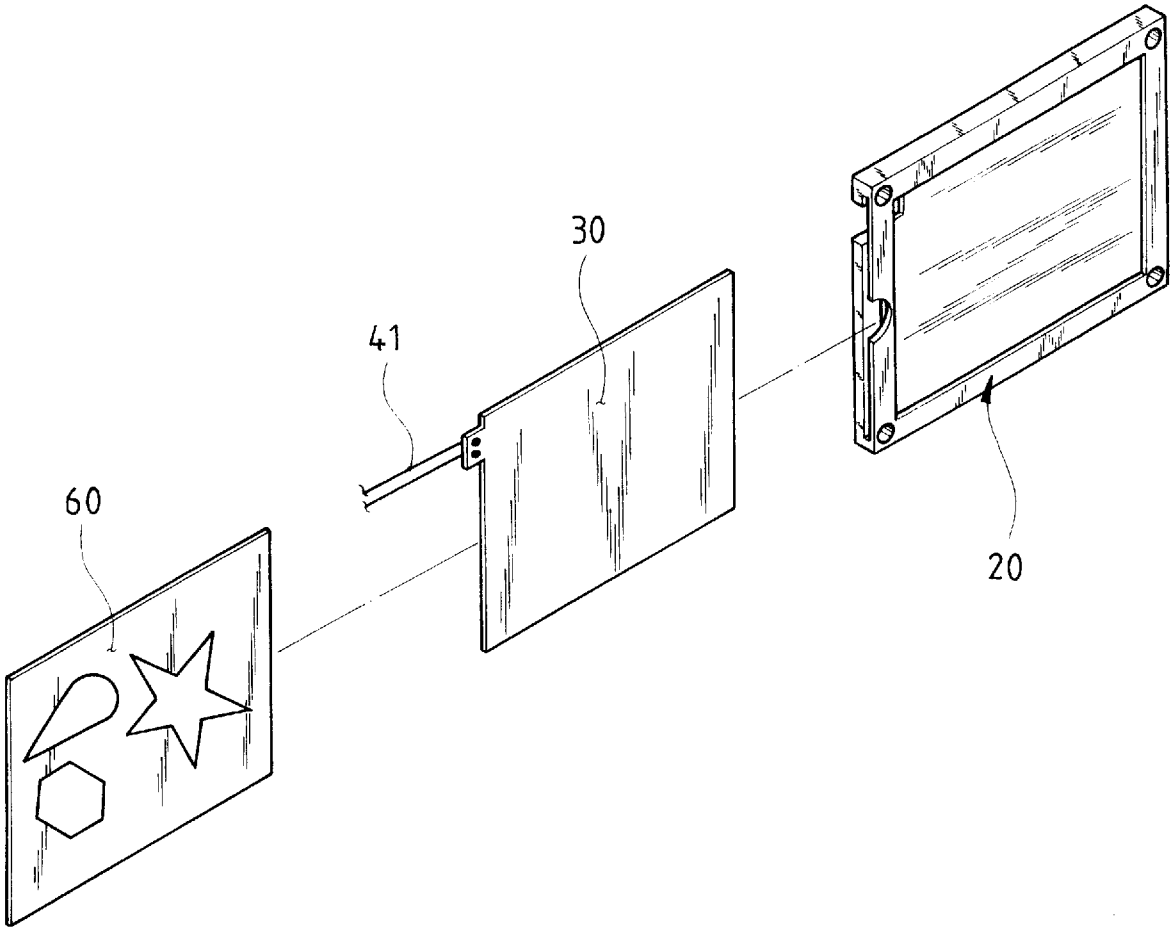
FIG. 5 is a structural schematic diagram of the frame that allows placement of objects (20) and the luminescent board (30) and the pattern card (60) of the present invention.

Please consult FIG. 5. Said luminescent board (30) is first inserted into the frame that allows placement of objects (20), and then the pattern card (60) is inserted into the frame that allows placement of objects. Said pattern card (60) is superimposed on the luminescent board (30). The pattern portion of said pattern card (60) is transparent and permits the transmission of light. The non-pattern portion does not permit the transmission of light. That is, the luminescence emitted by the luminescent board (30) can, by means of the transparent portion of the pattern card (60), exhibit the needed pattern.

THE BEST EMBODIMENTS OF THE INVENTION

The present invention, by means of first inserting the luminescent board (30) into the frame that allows placement of objects (20) and then inserting the pattern card (60) into the frame that allows placement of objects (20), with said frame that allows placement of objects (20) being fastened by screws to the front end of the cap (10) by means of four set screws inserted through the circular apertures (24) of the four corners of the frame that allows placement of objects (20), and then by placing the battery assembly (40) in the pocket that allows placement of an object (11) on one side of the cap (10), is assembled into one entire structure thereby, such that users may, according to need, remove and replace pattern cards (60) and thereby achieve the new design for replacing patterns.

In summary, the practical effect of the present invention is truly superior to that of conventional products. The fact that patterns can be replaced by removing and replacing pattern cards especially adds to the interesting and diversified effect. Furthermore, no disclosure of a product or publication which is the same as the present invention has been seen. The requirements for making a patent application have been complied with. I sincerely ask an examination and that the patent be granted. I would greatly appreciate such kindness.

I claim:

1. A type of luminescent cap with a function for replacing patterns which primarily comprises:

a cap, a frame that allows placement of objects, a luminescent board, a battery assembly, a circuit board, and a pattern card; wherein one side of said cap includes a pocket that allows placement of an object, said frame that allows placement of objects includes a hollow, bi-level slot to facilitate placement of objects, said frame that allows placement of objects also includes a rectangular slot aperture on a left-side corner of an edge of a base thereof, said frame that allows placement of objects further includes a semi-circular slot aperture in a central area of a left side of said frame, and each of four corners of said frame that allows placement of objects includes a circular aperture therein, said luminescent board is connected to said circuit board by connecting wires that connect said circuit board to said luminescent board and to said battery assembly;

a pattern portion of said pattern card is transparent and a rest portion of said pattern card is non-transparent, such that luminescence emitted by said luminescent board passes through the transparent portion of said pattern card and then exhibits desired pattern;

said luminescent board and said pattern card are inserted into said frame that allows placement of objects, said frame that allows placement of objects is fastened by screws on a front edge of said cap by means of four set screws inserted in said circular apertures of said four corners of said frame that allows placement of objects, and said battery assembly is placed in said pocket that allows placement of an object on one side of said cap.

* * * * *